United States Patent [19]

Goldfarb et al.

[11] 3,947,030

[45] Mar. 30, 1976

[54] TOY GAME OF CHANCE AND SKILL

[75] Inventors: Adolph E. Goldfarb, Tarzana; Erwin Benkoe, Encino; Dennis H. Merino, El Dorado Hills, all of Calif.

[73] Assignees: Adolph E. Goldfarb, Tarzana; Erwin Benkoe, Encino, both of Calif.

[22] Filed: Feb. 10, 1975

[21] Appl. No.: 548,796

[52] U.S. Cl. ..... 273/85 R; 46/127; 46/142; 273/108

[51] Int. Cl.[2] ..... A63F 9/14

[58] Field of Search ..... 273/1 R, 85 R, 85 B, 85 F, 273/108, 109, 110, 113, 114, 115, 116, 95 R; 46/107, 108, 127, 142

[56] References Cited

UNITED STATES PATENTS

| | | | |
|---|---|---|---|
| 853,278 | 5/1907 | Vining | 273/108 |
| 1,187,923 | 6/1916 | Pajeau | 273/108 |
| 2,601,739 | 7/1952 | Nicholls | 46/127 |
| 2,658,757 | 11/1953 | Elder | 273/95 R |
| 2,937,025 | 5/1960 | Bellak | 273/85 F |

FOREIGN PATENTS OR APPLICATIONS

| | | | |
|---|---|---|---|
| 14,195 | 9/1890 | United Kingdom | 46/142 |
| 13,186 | 6/1903 | United Kingdom | 46/142 |

*Primary Examiner*—Anton O. Oechsle
*Assistant Examiner*—Harry G. Strappello
*Attorney, Agent, or Firm*—Robert M. Ashen; Robert J. Schaap

[57] ABSTRACT

A toy game involving chance as well as strategy and skill which includes a playing structure having a pair of opposed spaced apart, generally parallel inclined ramps. The game is preferably played by two individuals, and each of which locate a playing piece, including a movable member, at the upper end of each of the ramps. Upon release of the movable members, they will roll down the inclined ramps toward each other. Each of the movable members removably carry a characterization figure, such that the movable member may adopt the design of a horse and the characterization figure may adopt the design of a man. Projecting elements, as for example, a lance, extend from each of the movable members. Moreover, camming means operate between the ramps and the projected elements to cause the projected elements to swing toward and away from the opposite ramp, so as to possibly engage the rider or other form of characterization figure on one of the movable members.

8 Claims, 5 Drawing Figures

FIG. 4
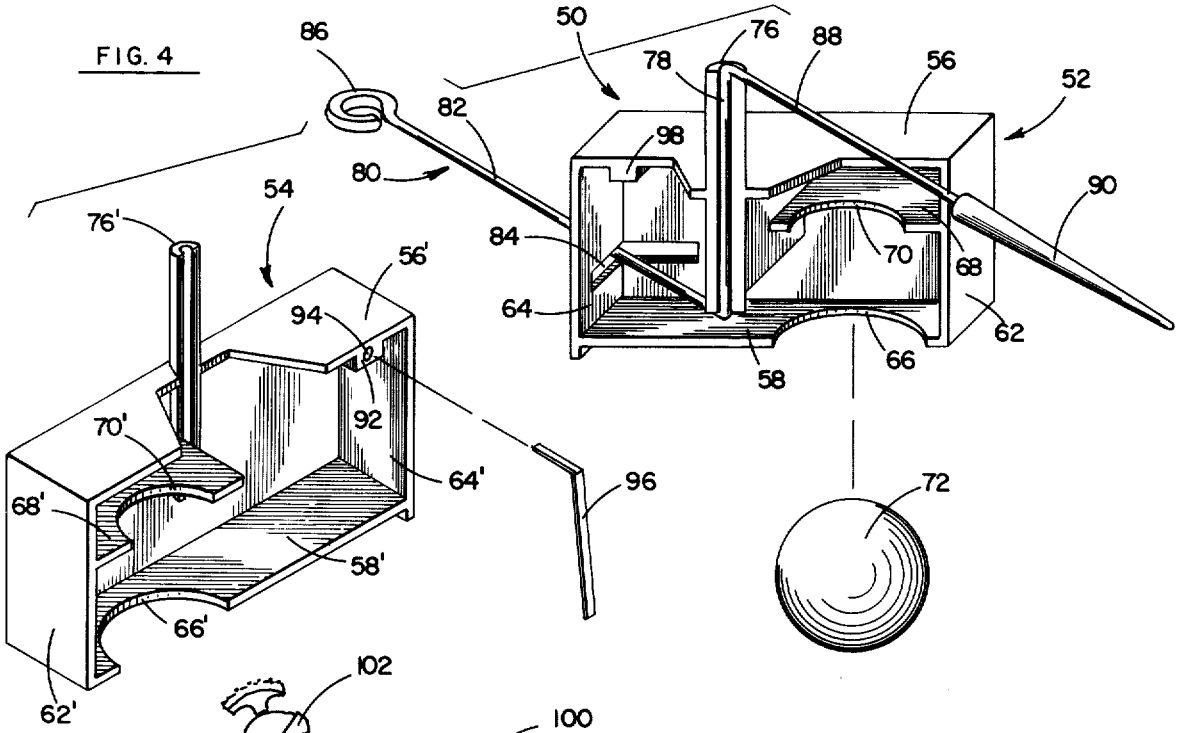
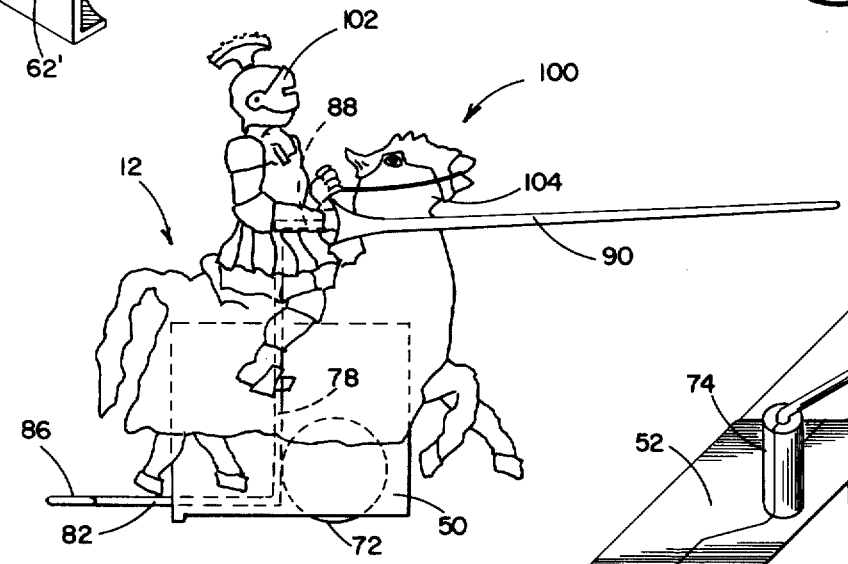
FIG. 5
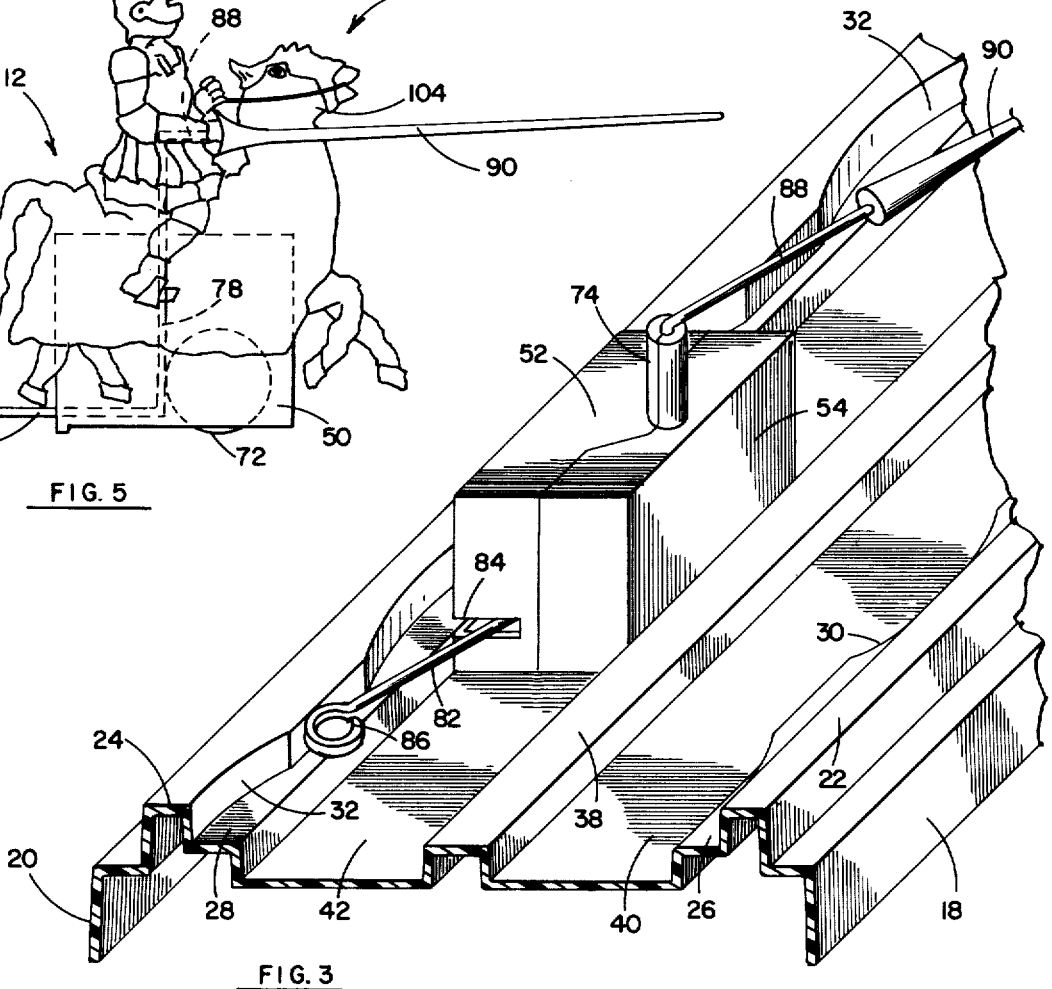
FIG. 3

TOY GAME OF CHANCE AND SKILL

This invention relates in general to certain new and useful improvements in toy games, and, more particularly, to toy games which involve chance, as well as strategy and skill.

There have been several commercially available forms of competitive toy games where two or more players cause the movement of playing pieces in various trackways for competitive engagement. These toy games generally rely upon movement of the two playing pieces in their respective trackways which enables some form of engagement in such manner that one of the players will cause his playing piece to engage or otherwise coact with the other playing piece to prevail on the other playing piece. These playing pieces may, if desired, employ a movable element which would engage the other playing piece. However, each of these playing pieces are either propelled by or actuated by electro-mechanical forms of drive mechanisms.

The toy game of the present invention is highly effective in that it permits children to engage in a game of chance by utilizing playing pieces and which also permits the exercise of strategy and skill. The playing game of the present invention comprises a playing structure having a pair of inclined ramps which incline toward each other. A playing piece is located at the upper end of each of these ramps. The playing piece may comprise a movable member which will move down the ramp toward the other movable member.

The movable member may adopt the characterization of a horse or similar item and it may also carry a characterization figure, such as a man. Moreover, each of the movable members are provided with a projected element which may adopt the form of a lance.

Camming means is operable between the ramp on which the movable member is located and the projected element. This camming means may adopt the form of a camming surface in the ramp and the projected element will be connected to a cam follower which engages the camming surface in the ramp. In this way, the projected element will be swung toward and away from the movable member in the opposite ramp.

The game requires some exercise of skill and strategy by selecting the proper time in which to release the movable member relative to the release of the movable member of the opponent. The element of chance also is introduced by having the movable member of one player in such a position that the projected element will be biased into engagement with the movable member of the opponent at the proper time.

It is, therefore, the primary object of the present invention to provide a toy game of chance and skill which enables the players of the game to permit at least two movable members to advance toward each other down opposed inclined ramps for selectively engaging the movable member of the other player.

It is another object of the present invention to provide a toy game of the type stated which may adopt a variety of forms of playing pieces and therefore lends itself to construction of a wide variety of toy game embodiments.

It is a further object of the present invention to provide a toy game of the type stated which can be constructed with a minimum number of movable components and which can therefore be manufactured at a relatively low cost.

It is an additional object of the present invention to provide a toy game of the type stated which can be manufactured of selected molded plastic materials, and therefore includes components which are relatively durable and can be designed with a highly effective aesthetic appearance.

It is another salient object of the present invention to provide a method of playing a game having movable members which are released for movement towards each other and which involves chance as well as skill and strategy.

With the above and other objects in view, our invention resides in the novel features of form, construction, arrangement and combination of parts presently described and pointed out in the claims.

Having thus described the invention in general terms, reference will now be made to the accompanying drawings in which:

FIG. 3 is a perspective view, partially broken away and in section, and showing a portion of the game board and a portion of one of the playing pieces forming part of the toy game of the present invention;

FIG. 4 is a perspective view, showing two selections of one of the playing pieces forming part of the toy game of the present invention; and FIG. 5 is a side-elevational view, partially shown in dotted lines, of one of the playing pieces forming part of the toy game of the present invention.

Figure 1:
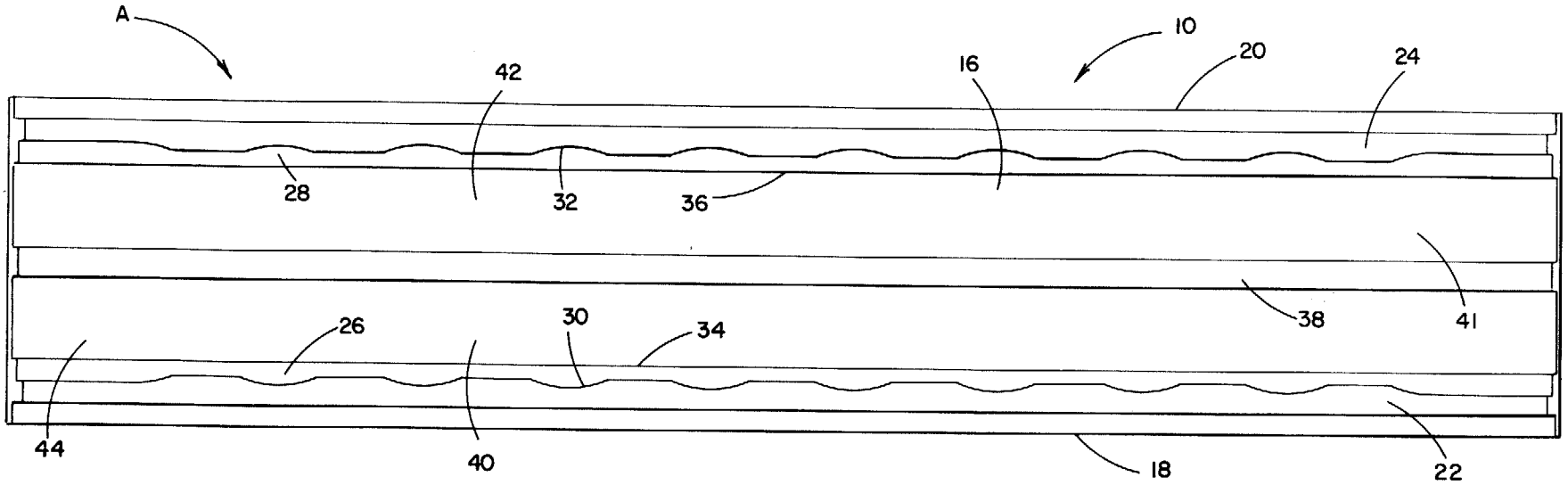
FIG. 1 is a top plan view of a game board forming part of the playing game of the present invention.
Figure 2:
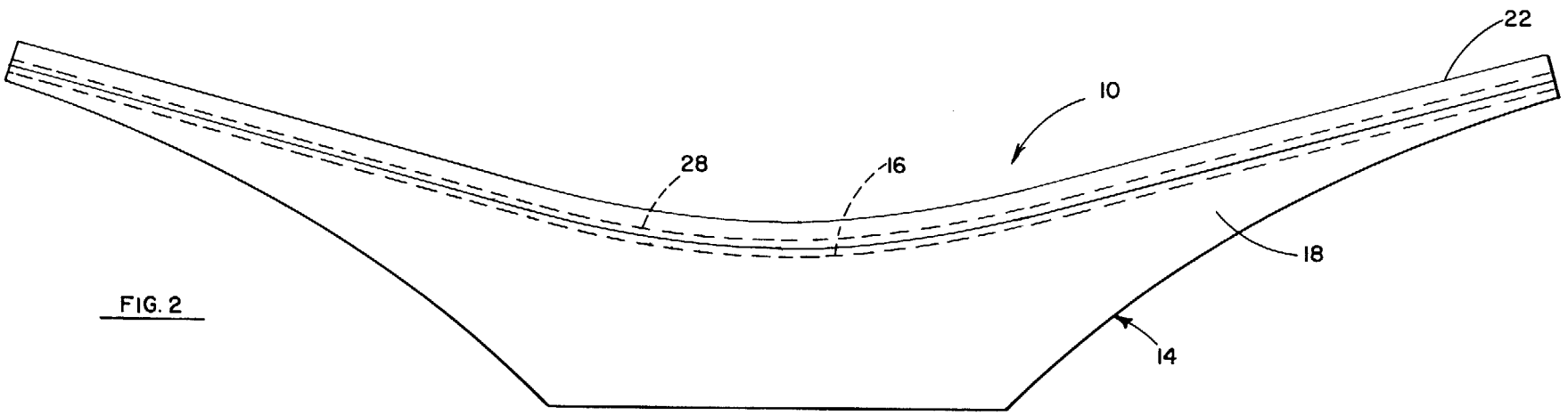
FIG. 2 is a side-elevational view, partially shown in dotted lines, of the game board of FIG. 1.

Referring now in more detail and by reference characters to the drawings which illustrate a preferred embodiment of the present invention, A designates a toy playing game of chance and skill comprising a game structure 10, more fully illustrated in FIGS. 1 and 2, and a pair of playing pieces 12, one of which is more fully illustrated in FIGS. 3–5 of the drawings.

The game structure 10 generally comprises a base 14 with a top playing surface 16. The base 14 is generally comprised of a pair of longitudinally extending spaced apart vertical support walls 18 and 20. Moreover, the playing structure 12 is provided with a pair of upstanding outer retaining rails 22 and 24, at the outer longitudinal margins thereof, in the manner as illustrated in FIGS. 1, 2 and 3 of the drawings. The outer retaining rails 22 and 24 integrally merge into inwardly extending guide rails 26 and 28, and each of which has inwardly presently camming surfaces 30 and 32 respectively, for reasons which will presently more fully appear. In addition, the guide rails 26 and 28 each integrally merge in vertically disposed guide walls 34 and 36.

An intermediate divider 38 is upwardly struck on the playing surface 16 and divides the playing surface 16 into a pair of opposed longitudinally extending and parallel playing ramps 40 and 42, in the manner as illustrated in FIGS. 1 and 3 of the drawings. It can be observed that the playing ramps 40 and 42 are defined by the vertical walls of the intermediate divider 38, as well as the vertical guide walls 34 and 36.

By further reference to FIG. 2, it can be seen that the upper playing surface 16 is arcuately shaped in its construction so that the ramps 40 and 42 are similarly arcuately shaped. Furthermore, it can be observed that each of the ramps are inclined from their upper outer ends toward the center which defines a low point in each of the ramps 40 and 42. Each of the ramps has a pair of opposed upper ends and, thus, in this case, only one of these ends on each of the ramps is used as a starting location. Thus, the upper end of the ramp 40 will have a starting location 44 at its leftmost upper end, reference being made to FIG. 1, and the ramp 42 will have an initial starting location 46 at its righthand upper end, reference being made to FIG. 1. In like manner, it can be observed that the starting locations could be reversed for each of these ramps.

The playing structure 14 may be formed as an integrally molded structure by any of a number of conventional plastic molding arrangements, as for example thermo-forming, injection molding or the like. Again, any of a number of known plastic materials may be used in the formation of this playing structure 14 and include, for example, polyethylene, polystyrene, polybutadiene and the like. As an alternative, it should be understood that the playing structure 14 could also be formed of other materials including metal and the like.

The playing pieces which are used in the present invention are more fully illustrated in FIGS. 3–5 of the drawings. In this case, each playing piece comprises a movable member in the form of an outer housing 50 comprised of a first or outer housing section 52 and a second or inner housing section 54. The housing sections 52 and 54 are each constructed with top walls 56 and 56' along with bottom walls 58 and 58' which are connected at their ends by vertically disposed side walls 62 and 62' and 64 and 64'. Moreover, it can be seen that the two housing sections are essentially rectangular in their construction. Each of the top walls and bottom walls, as well as the respective side walls, provide abutting vertically disposed alignable margins such that the two sections 52 and 54 may be secured together.

Each of the housing sections 52 and 54 are provided on their lower walls 58 and 58' with alignable, semicircular slots or receiving recesses 66 and 66', which form a complete circular ball receiving aperture when the two housing sections 52 and 54 are secured together. In like manner, each of the housing sections 52 and 54 are provided with horizontally disposed walls 68 and 68' which are similarly provided with arcuate recesses 70 and 70'. The recesses 70 and 70' also similarly form a complete circular aperture when the two housing sections 52 and 54 are secured together. Moreover, it can be observed that the circular aperture formed by the recesses 70 and 70' are smaller than the aperture formed by the recesses 60 and 60'.

These recesses, mentioned above, form a ball receiving socket within the housing 50, such that the diameter of a ball 72 retained therein is larger than the diameter of the circular aperture formed by the lower recesses 66 and 66', as well as the circular aperture formed by the upper recesses 70 and 70'. In this way, the ball 72 is retentively retained within the housing 50 and the size of the circular aperture formed by the upper recesses 70 and 70' is such to limit the upper movement of the ball 72 so that it is always outwardly projecting from the lower walls 58 and 58'. Moreover, the diameter of the circular aperture formed by the recesses 60 and 66' is such that the ball 72 can never be expelled from the housing and is always retained therein. In this way, the ball 72 serves as a form of roller which permits movement of the housing 50 on the respective ramps 40 and 42. It can also be observed that the overall size of the housing 50 is such that it fits within the ramps as defined by the vertical walls on the intermediate divider 38 and the guide walls 34 and 36, as more fully illustrated in FIG. 3 of the drawings.

The housing 50 is also provided with an upstanding tubular post 74 which is formed by post sections 76 and 76' in each of the housing sections 52 and 54, respectively. These post sections are also provided with elongated semicircular recesses in the manner as illustrated in order to form the tubular central aperture in the tubular post 74.

Fitted within the tubular post 74 is the vertically disposed pivotal section 78 of a wire form 80. The wire form 80 is also integrally formed with a rearwardly struck cam follower arm 82 which extends outwardly of the housing section 52 through an enlarged elongated slot 84 formed within the vertical walls of the housing, in the manner as illustrated in FIG. 4 of the drawings. The cam follower arm 82 is provided at its outer end with a cam follower 86 which is designed to engage the camming surfaces 30 or 32. The upper end of the pivot section 78 of the wire form 80 is provided with an outwardly extending lance-retaining arm 88 upon which a lance 90 is mounted at the outer end thereof.

Thus, it can be observed that as the movable member 50 moves dowardly within one of the ramps, as for example from the initial starting location 44, the cam follower 86 will engage the camming surface 30. As the movable member 50 continues to move downwardly upon the ramp through the rolling action of the steel ball 72, the cam follower 86 will engage the undulating valleys and hills in the camming surfaces 30 and cause the lance 90 to shift back and forth in a horizontal plane. As this occurs, it can be observed that the lance 90 will shift in a reciprocative pattern from the ramp 40 over and into the ramp 42.

In this respect, it can be observed that the camming surface can be undulating in the manner as illustrated in FIGS. 1 and 3 of the drawings, or otherwise it could be of a random nature in order to provide a random shiftable movement of the lance 90.

It should also be observed in connection with the present invention that the lance could be substituted for by any other form of projecting element, such that the projecting element is capable of moving into the other ramp.

The housing section 54 is provided near its rearward end, reference being made to FIG. 4, with a downwardly extending boss 92 having a circular aperture 94 formed therein in order to accommodate one end of a spring 96. The vertical wall of the spring is retained by means of a spring retainer wall 98 formed on the inner end of the top wall 56 on the housing section 52. Moreover, it can be observed that the spring 96 is so located so as to bear against the cam follower arm 82 and thereby bias the cam follower 86 into engagement with one of the camming walls 30 o4 32. As the cam follower 96 is urged inwardly toward the intermediate divider 38, it is biased outwardly again by the action of the spring 96. In essence, the spring 96 is formed of tempered steel so as to be sufficiently resilient and perform the biasing action. In this respect, any form of spring member or other form of biasing member could be used in order to bias the cam follower arm 82 outwardly.

Fixedly or removably disposed on the housing 50 is a characterization figure 100, as for example the characterization of a knight 102 on a horse 104. In this case, the knight 102 can be removably mounted on the horse 104 whereas the horse 104 may be fixed to the housing 50. However, it should be observed that any other form of characterization figure may be provided. For example, a tank may be fixedly mounted on the housing 50 and with a tank turret removably disposed on the tank body. In this case, the lance would be substituted by a cannon barrel extending from the turret.

In use, the two players each place a similar playing piece at the upper end of the opposed ramps, as for example at the initial starting locations 44 and 46. Each player can decide at the approximate time when he releases his respective playing piece. Upon release, the playing pieces will move downwardly in the respective ramps 40 and 42 until they reach a point toward the lower mid-portion of the two ramps. As the two playing pieces are moving downwardly within the ramps, the cam follower 86 will bear against either of the camming walls 30 or 32 and hence cause the lance 90 to shift in a reciprocative manner back and forth between the two ramps 40 and 42. When the two playing pieces reach the lower mid-point of the respective ramps, if the lance of one of the playing pieces is shifting toward the ramp of the opposite player, then the lance will knock the knight off of the horse of the other player and thereby win a joust. In this same respect, it can be noted that in the case of a joust game, the respective lances of each of the players could be located in the opposite ramps at the time that contact is made, thereby enabling each of the players to knock the knight off of the other player's horse.

As indicated previously, other forms of characterization figures could be used on the playing pieces to thereby form a variety of games with the basic structure hereinabove described. Again, it should be observed that the various playing pieces, including the housings 50 and the characterization figures 100 located thereon, could also be formed of suitable molded plastic materials, as for example those materials described above.

The toy game of the present invention operates on the basis of chance as well as skill and strategy, as described above. The chance element arises from the release of the movable members at a selected time and, if the lance of one of the members is located in the ramp of the other member at the appropriate time of contact, then the player who knocks the characterizaton figure off of the movable member of the opponent would win the game. The skill and strategy arises from enabling each player to select a proper time to release his playing piece.

It should be understood in connection with the present invention that other forms of playing pieces could be utilized in accordance with the present invention, as indicated above. Thus, the playing piece could employ a reciprocative or other form of movable element which could engage, or either operatively engage, the other playing piece. When the movable element of one playing piece engages the other playing piece, it could dislodge the playing piece, or a figure on the playing piece, or even an element on the playing piece. Thus, the movable element of one playing piece could dislocate or dislodge only a portion of the other playing piece. Thus, for example, this movable element could contact a contact point on the other movable playing piece and create a visual indication, as for example a flag which would be raised or otherwise shifted for visual indication of contact.

Thus, there has been illustrated and described a unique and novel toy game which permits playing of the game with an element of chance as well as with elements of strategy and skill and which therefore fulfills all of the objects and advantages sought therefor. It should be understood that many changes, modifications, variations and other uses and applications of the toy playing game will become apparent to those skilled in the art after considering this specification and the accompanying drawings. Therefore, all such changes, modifications, variations and other uses and applications which do not depart from the nature and scope of the invention are deemed to be covered by the invention which is limited only by the following claims.

Having thus described our invention, what we desire to claim and secure by letters patent is:

1. A toy game of chance and skill comprising:
   a. a pair of opposed inclined ramps located in operative relationship to each other,
   b. a movable member capable of being disposed in each of said ramps at opposite ends thereof for movement toward each other,
   c. a projected element operatively mounted on each of said movable members and shifting in a reciprocative motion toward and away from the ramp in which the member it is associated with is located, and
   d. camming means operable between said projected element of each said movable members and the associated ramp for moving the projected element in the reciprocative motion during movement down the inclined ramp, whereby the projected element of one movable member may engage the movable member in the other of the ramps and dislocate at least a portion of the same during movement on the respective ramps.

2. The toy game of claim 1 further characterized in that said pair of ramps are located in juxtaposition to each other.

3. The toy game of claim 1 further characterized in that each of said movable members carries a characterization figure thereon which is capable of being struck by the projected element of the other movable member and being dislodged from its associated movable member when struck by the projected element of the other movable member.

4. The toy game of claim 3 further characterized in that camming means is connected to the projected element in such construction that the projected element associated with each movable member swings into and away from the ramp of the movable member with which it is associated.

5. The toy game of claim 4 further characterized in that the movable member is a characterization representation of a horse, the characterization figure is the characterization of a rider on said horse, and the projected element is a lance.

6. The toy game of claim 1 further characterized in that roller means is operatively associated with each of said movable members for permitting movement of each of said movable members in its associated ramp.

7. The toy game of claim 1 further characterized in that said camming means comprises a camming section formed with each of said ramps and an extended cam actuating member connected to the projected element on each such member and being engageable with the associated cam section in its ramp.

8. The toy game of claim 7 further characterized in that biasing means is operatively associated with each of said movable members and the projected element associated therewith for biasing the cam actuating member of each projected element into engagement with its associated camming surface.

* * * * *